US006843886B1

(12) United States Patent
Huovinen et al.

(10) Patent No.: US 6,843,886 B1
(45) Date of Patent: Jan. 18, 2005

(54) METHOD FOR HANDLING FILLED REJECT FLOWS IN A PAPER OR PAPERBOARD MILL

(75) Inventors: Mauno Huovinen, Karkkila (FI); Hannu Virtanen, Tampere (FI)

(73) Assignee: Megatrex Oy, Lempaala (FI)

( * ) Notice: Subject to any disclaimer, the term of this patent is extended or adjusted under 35 U.S.C. 154(b) by 90 days.

(21) Appl. No.: 10/129,563

(22) PCT Filed: Nov. 24, 2000

(86) PCT No.: PCT/FI00/01022

§ 371 (c)(1),
(2), (4) Date: May 8, 2002

(87) PCT Pub. No.: WO01/38632

PCT Pub. Date: May 31, 2001

(30) Foreign Application Priority Data

Nov. 24, 1999 (FI) ..... 19992497

(51) Int. Cl.[7] ..... D21F 1/66
(52) U.S. Cl. ..... 162/55; 162/189; 210/928
(58) Field of Search ..... 162/189–190, 162/55–57, DIG. 9; 210/928

(56) References Cited

U.S. PATENT DOCUMENTS

| | | | | | |
|---|---|---|---|---|---|
| 3,235,444 | A | * | 2/1966 | Kruger | 162/190 |
| 3,364,101 | A | * | 1/1968 | Eek | 162/12 |
| 3,849,245 | A | * | 11/1974 | Marsh et al. | 162/4 |
| 3,876,497 | A | * | 4/1975 | Hoffman | 162/189 |
| 3,912,579 | A | * | 10/1975 | Braun | 162/4 |
| 4,030,968 | A | * | 6/1977 | Goel et al. | 162/16 |
| 4,263,830 | A | | 4/1981 | Burstrom | 411/477 |
| 5,478,441 | A | | 12/1995 | Hamilton | 162/189 |
| 5,536,371 | A | * | 7/1996 | Verhoff | 162/189 |
| 5,776,304 | A | * | 7/1998 | Vikio | 162/4 |
| 6,202,946 | B1 | | 3/2001 | Virtanen | 241/21 |
| 6,207,015 | B1 | * | 3/2001 | Templer et al. | 162/189 |
| 6,214,166 | B1 | * | 4/2001 | Munchow | 162/189 |
| 6,444,092 | B1 | * | 9/2002 | Munchow | 162/189 |
| 6,572,736 | B2 | * | 6/2003 | Bush et al. | 162/189 |
| 2002/0060014 | A1 | * | 5/2002 | Sipila et al. | 162/189 |
| 2003/0041990 | A1 | * | 3/2003 | Munchow | 162/189 |

FOREIGN PATENT DOCUMENTS

| | | | | |
|---|---|---|---|---|
| DE | 19627523 C1 | * | 10/1997 | D21F/1/66 |
| FI | 955474 | | 12/1996 | |
| WO | WO 96/18454 | | 6/1996 | |
| WO | WO 96/19283 | | 6/1996 | |
| WO | WO 99/54045 | | 10/1999 | |

* cited by examiner

*Primary Examiner*—José A. Fortuna
*Assistant Examiner*—Tywana Lovelace
(74) *Attorney, Agent, or Firm*—James C. Lydon

(57) ABSTRACT

A method and device for processing sewage which contains coating paste from a paper or board mill with a device operating on the principle of a double action impact mill. The device includes a first rotor (11) equipped with blades; a second rotor (12) concentric with the first rotor, equipped with blades and arranged to rotate in a direction opposite to the direction of the first rotor, or a stator concentric with the first rotor and equipped with blades. The sewage is led to a feed opening (14) which opens out to the nave of rotors (11, 12) or to the nave of the rotor and the stator. In the device, the material flow is brought to flow as a flow-off through the blades of the rotors (11, 12) arranged within each other, or of the rotor and the stator arranged within each other.

9 Claims, 9 Drawing Sheets

VORTEX CLEANING PLANT IN A PAPER MACHINE

METHOD FOR HANDLING FILLED REJECT FLOWS IN A PAPER OR PAPERBOARD MILL

Figure 1A:
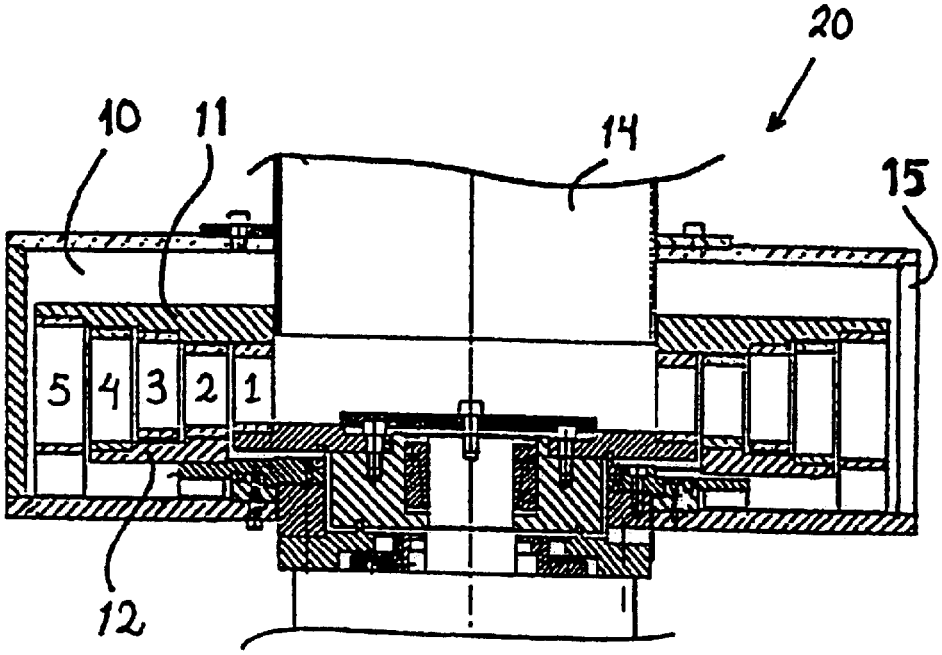

This application is a U.S. national stage of International Application PCT/F100/01022, filed Nov. 24, 2000 and published on May 31, 2001 in the English Language.

The present invention relates to a method and a device for handling filled reject flows in a paper or board mill.

The purpose of coating paper and board is to improve printability and appearance. In particular, opacity, brightness and gloss are important parametres which can be affected by coating.

The coating is performed by applying a coating paste onto a paper or board web at a coating station in the machine. In principle, the coating paste consists of four components, i.e. one or more pigments, one or more adhesives, a viscosity regulating agent (or agents), as well as various additives, wherein all the components are mixed in water.

The function of the pigments is particularly to improve opacity and surface properties of paper or board. The pigments are typically inorganic compounds, such as kaolins, carbonates, talcum, and gypsum. The ready paste typically contains 85 to 95% of pigment in the dry substance.

The function of the adhesives is to attach the pigments to the surface of the paper or board and to bond the pigment particles to each other. The adhesives are typically latexes and starches. The ready paste typically contains 5 to 15% of a adhesives.

The most typical viscosity regulating agent is carboxymethyl cellulose (CMC). The additives are particularly colouring agents, antislime agents, etc. Their content in the paste is approximately 1% or less.

The consumption of the coating is considerable. Approximately one third of the production of LWC paper is coating. In some paper grades, the content of the coating can be even more than 40%.

The quantity of coating that is passed with sewage is approximately 5 to 15% of the quantity of the produced coating. According to prior art and tests carried out, it has been found that such paste residues can-not be used as a filler in a paper or board machine, because the additives included in the coating paste, such as latexes, cause problems when they are supplied in wet condition to the paper or board machine. If the latexes are first dried, they can be fed back to the wet end of the paper or board machine. This is the case when slushed broke is used as pulp.

By filtering such sewage (sewage from the coating station and white water), it is possible to save a considerable quantity of the coating. In practice, small particles of the coating are recovered by ultrafiltration. The concentrate (pigments) recovered by ultrafiltration can be recycled to the production of the coating, to the fresh coating paste.

However, ultrafiltration involves several problems. An ultrafiltration apparatus is expensive both as an investment and with respect to its maintenance. Furthermore, problems are involved in the change of paper grade from gravure grade to offset grade and vice versa, because coating pastes intended for different printing methods contain different quantities of adhesives and they may thus make it difficult to use the final product or impair the printing result.

Publication WO 99/54045 discloses a method and an apparatus for the processing of stock in a paper mill. The publication discloses how broke from a papermaking process, containing fibres and filler, for example paper trimmings and other broke in web form, is first sludged and, after the sludging, agglomerates are slushed from the sludge. The disintegrated material can be recycled for re-use. The apparatus for disintegrating the material operates on the principle of a double action impact mill.

Apparatuses operating on the principle of a double action impact mill are prior known for example from the Danish patent publication DK 104778, to which corresponds U.S. Pat. No. 4,263,830; and from Finnish patent applications Fl 945945, to which corresponds WO 96/18454; Fl 946048, to which corresponds WO 96/19283; and Fl 955474. It is characteristic of these devices that two concentric rotors equipped with blades are fitted within each other in a housing and arranged to rotate in opposite directions therein. According to a second alternative, a rotor equipped with blades and a stator concentric with the rotor equipped with blades are arranged in the housing.

There has been an obvious need to develop a new and efficient method and device for simple processing of sewage which contains coating paste from a paper or board mill, so that such pigment-containing sewage could be re-used in processes of manufacturing paper or board. It is an aim of the present invention to achieve a new and efficient method and device for simple processing of reject flows from a paper or board mill, i.e. sewage which contains coating paste and a reject flow from a vortex cleaner, such as a vortex cleaning plant in a paper machine, and to recirculate them to the manufacturing process. Another aim is to provide a processing method and device allowing the supply of such pigment-containing reject flows to a paper or board machine, preferably to the supply of the 2nd or 3rd step of a vortex cleaning plant in a paper or board machine. In this way, pigment is utilized as a filler.

This aim is achieved by a method and a device according to the invention, which are characterized in what will be presented in the characterizing parts of the claims hereinbelow.

It has been found that when at least one sewage flow which contains coating paste and at least one reject flow from a vortex cleaner are simultaneously supplied as one material flow to be disintegrated, the disintegrated material can be reused in the manufacture of paper or board without affecting the quality of the paper or paperboard.

Advantages of the method and the device of the invention to be particularly mentioned include that

- in the new processing method, the fresh shear surfaces of disintegrated pigments and other particles are very reactive, wherein they effectively bind latexes and other substances which would otherwise cause problems when recirculated to the process;
- in the processing method, the filler particles, agglomerates and other pieces in the material flows are, irrespective of their size, immediately subjected to recurrent strong impacts changing their direction, shear forces and turbulence;
- the process subjects the material pieces to cyclic shocks of pressure and underpressure, which is advantageously contributed by the loosening of the pieces from each other at the same time when they are kept apart from each other during the short processing time; and
- by this method, the loosened particles remain separate from each other until they are centifuged out of the device.

The device according to the invention is provided with a feed opening which opens out to the nave of rotors or a rotor and a stator. If the device is equipped with a separate housing, the feed opening is placed at the end of the housing.

The processed material flow is discharged from the circumference of the outermost rotor or stator. If the device is equipped with a separate housing, the wall of the housing is provided with a delivery outlet opening to the ring of the outermost rotor or stator.

The material to be processed, which comprises sewage that contains coating paste and a reject flow from the vortex cleaner, and whose consistency is typically 0.5 to 65%, is led to a feed opening which opens to the nave of the rotors or the rotor and the stator, and is brought to flow through the blades of the rotors arranged within each other, or the rotor and the stator arranged within each other, as a flow-off from the device.

According to an advantageous embodiment, the suspension obtained as a flow-off from the double action impact mill is recirculated in whole or in part once or several times back to the double action impact mill. According to another advantageous embodiment, a device is used in which two double action impact mills are coupled in series.

According to one embodiment, the device according to the invention is equipped with a separate housing.

The number of rings in the device is at least two. The energy consumption of the device increases with the increasing number of rings, and an optimal number of rings is therefore about 2 to 5.

Preferably, several paste-containing sewage flows and/or paste-containing sewage and other filled reject flows can be simultaneously supplied to the double action impact mill, such as reject from vortex cleaners of waste pulp from a mill for producing coated paper or board.

In one embodiment, the material suspension produced at the double action impact mill is recirculated in whole or in part, once or several times, to the double action impact mill.

Figure 1B:
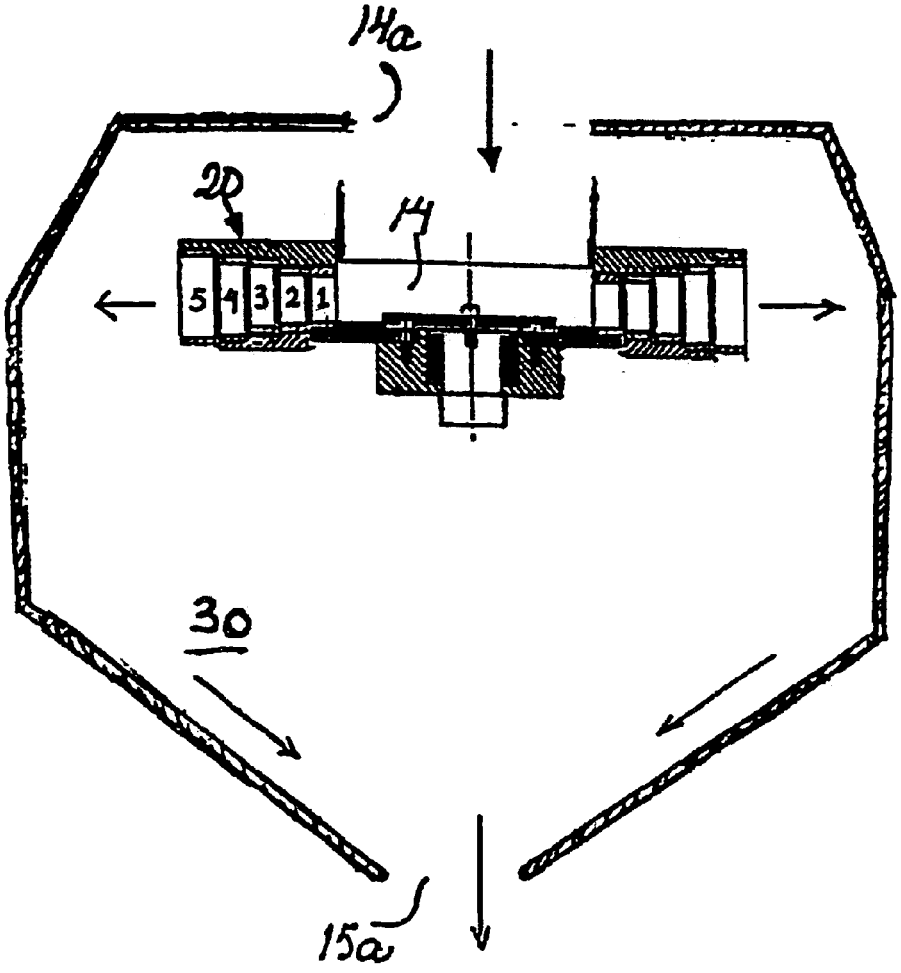
Figure 2:
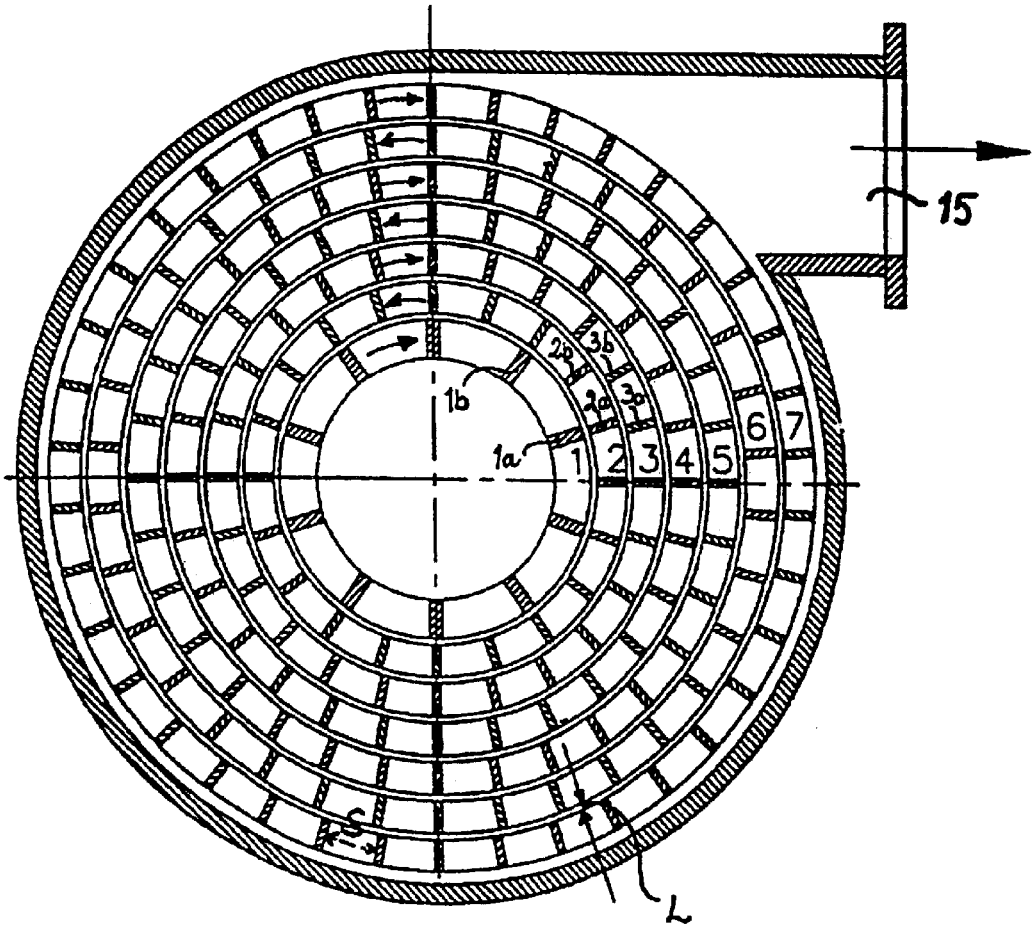
Figure 3:
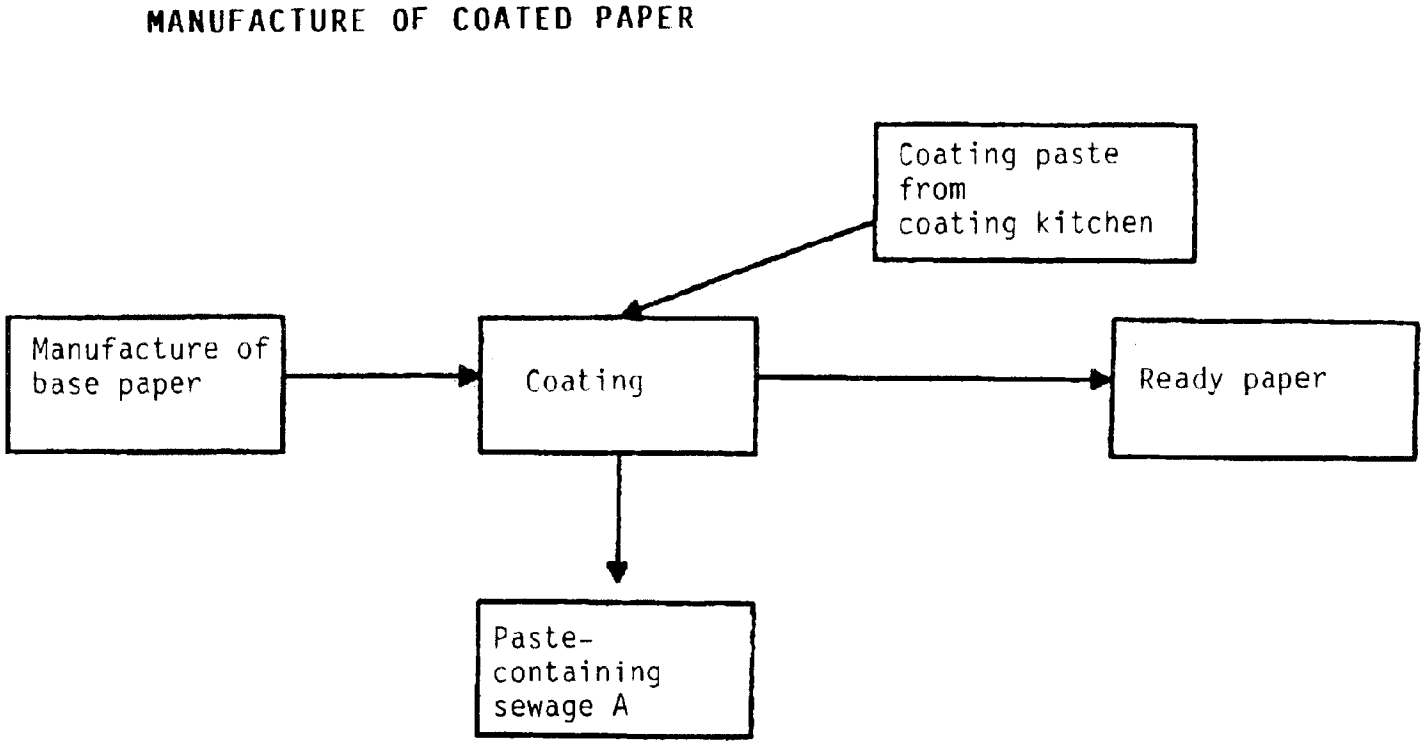
Figure 4:
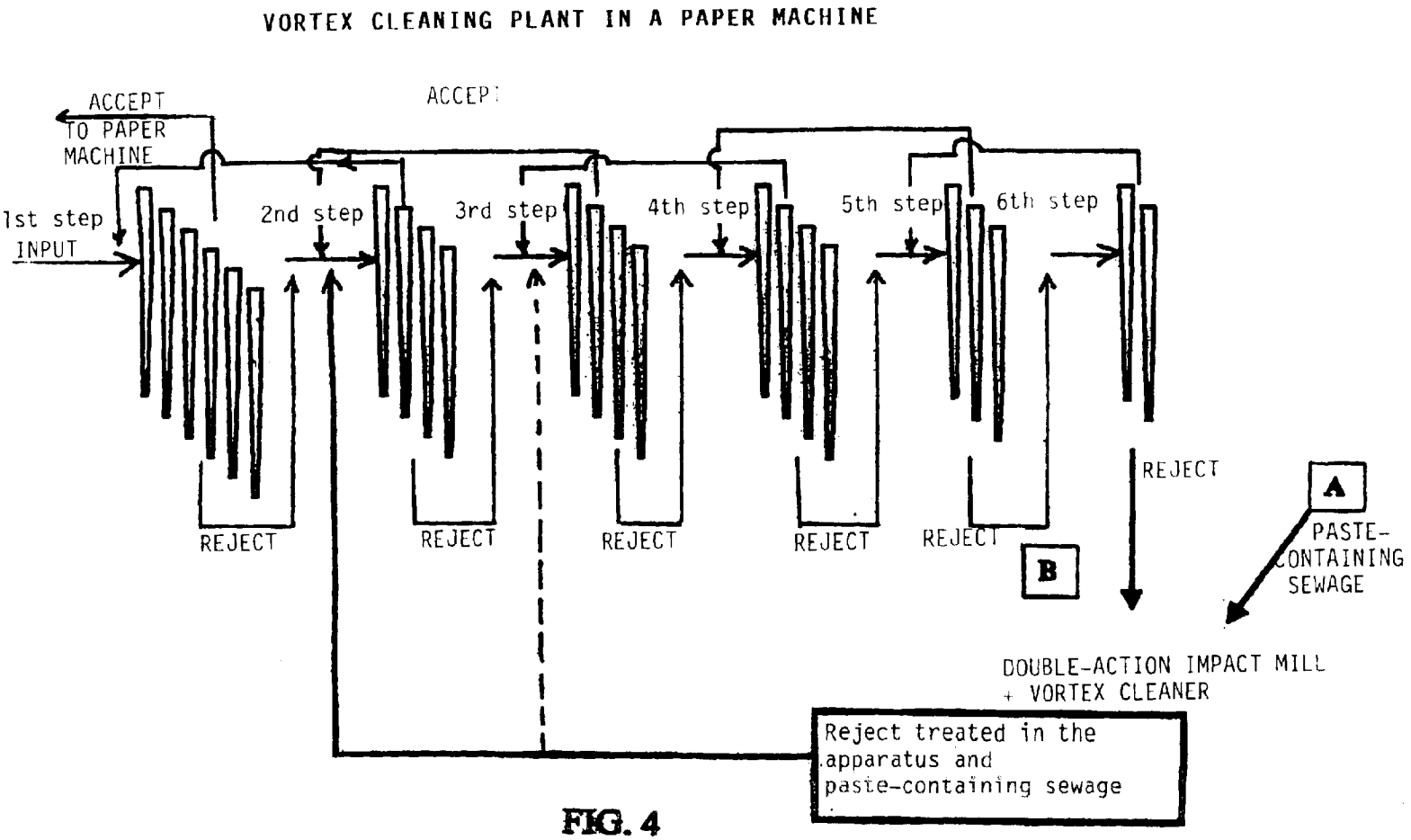
Figure 5:
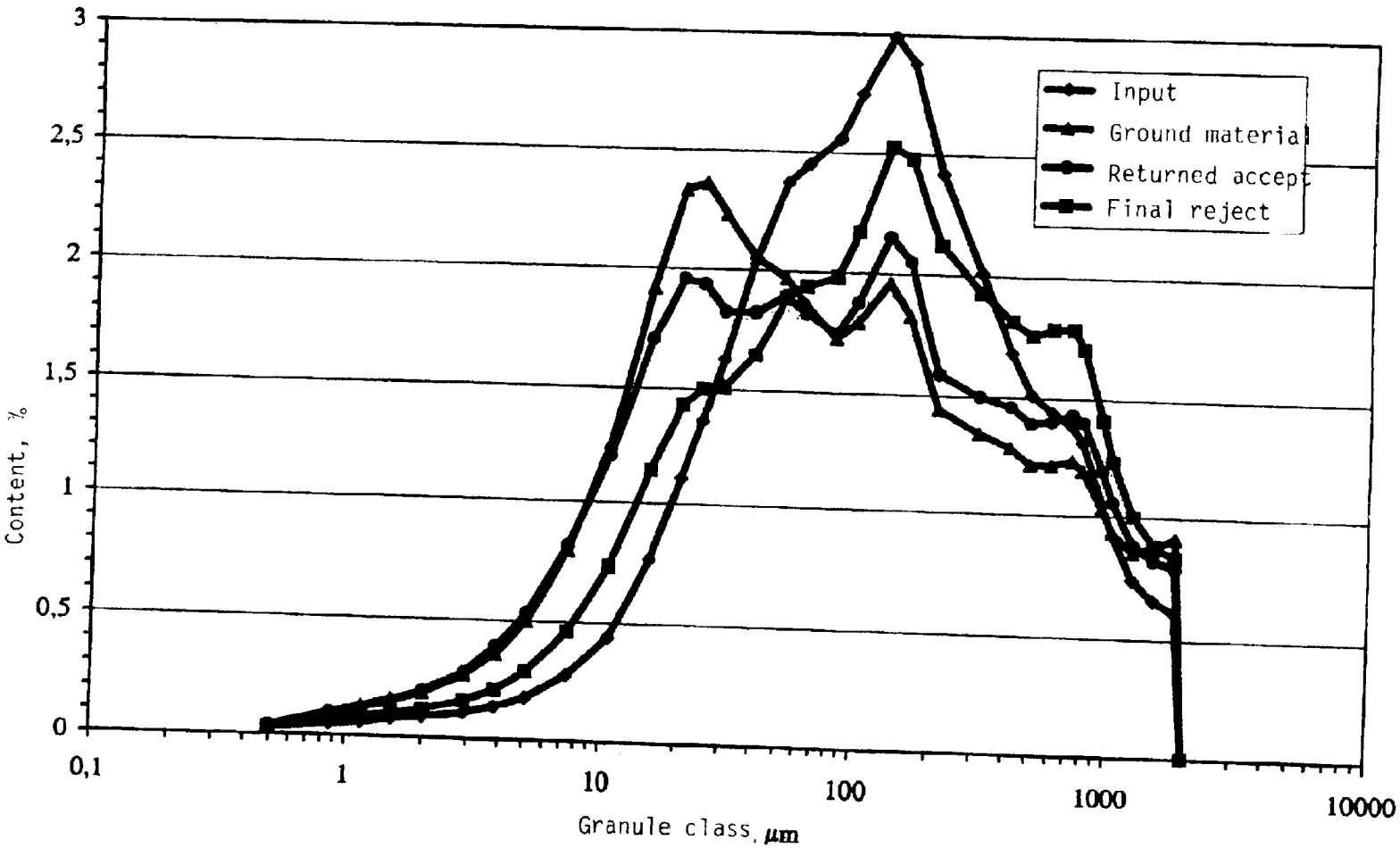
Figure 6:
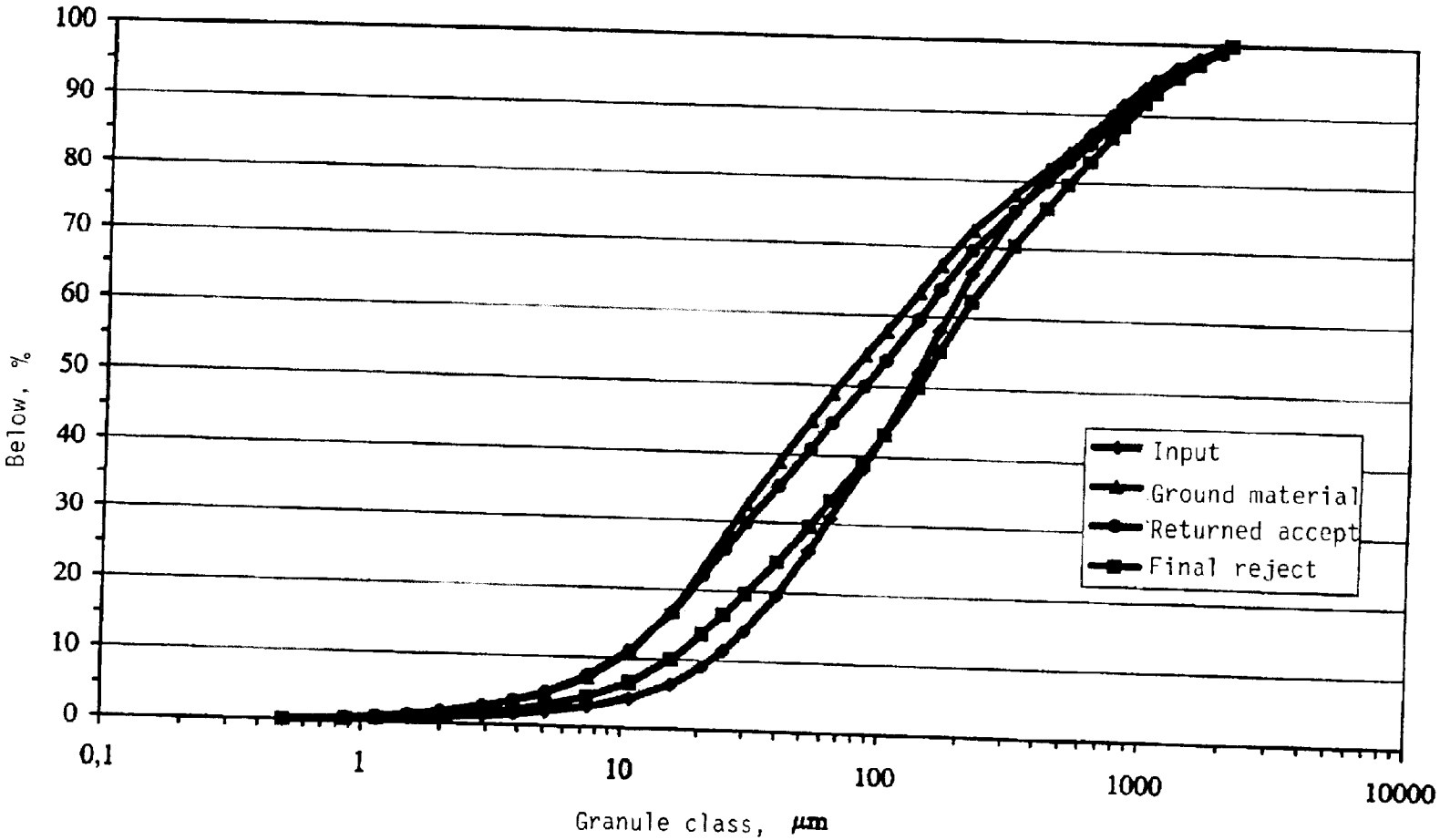
Figure 7A:
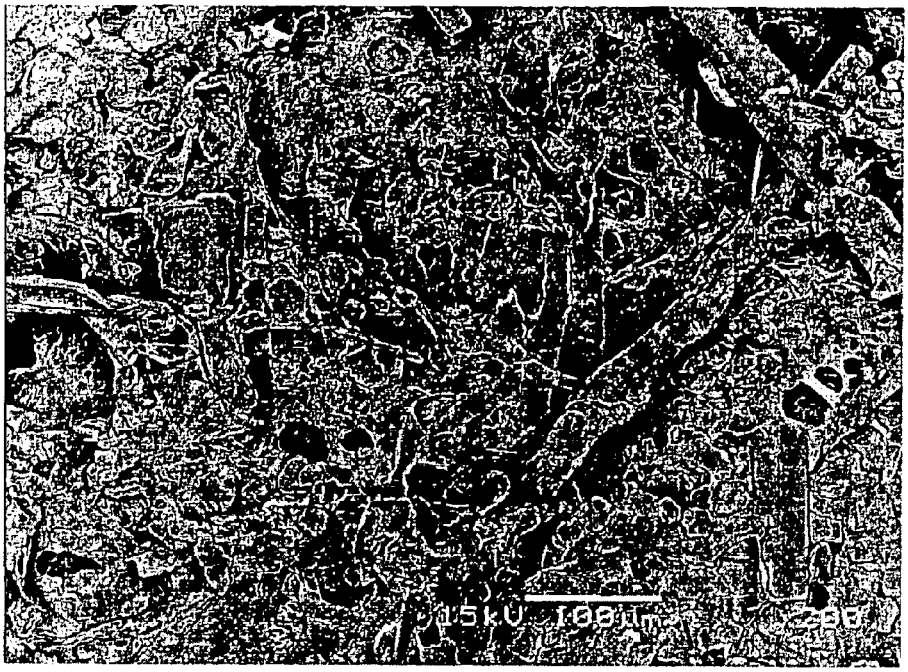
Figure 7B:
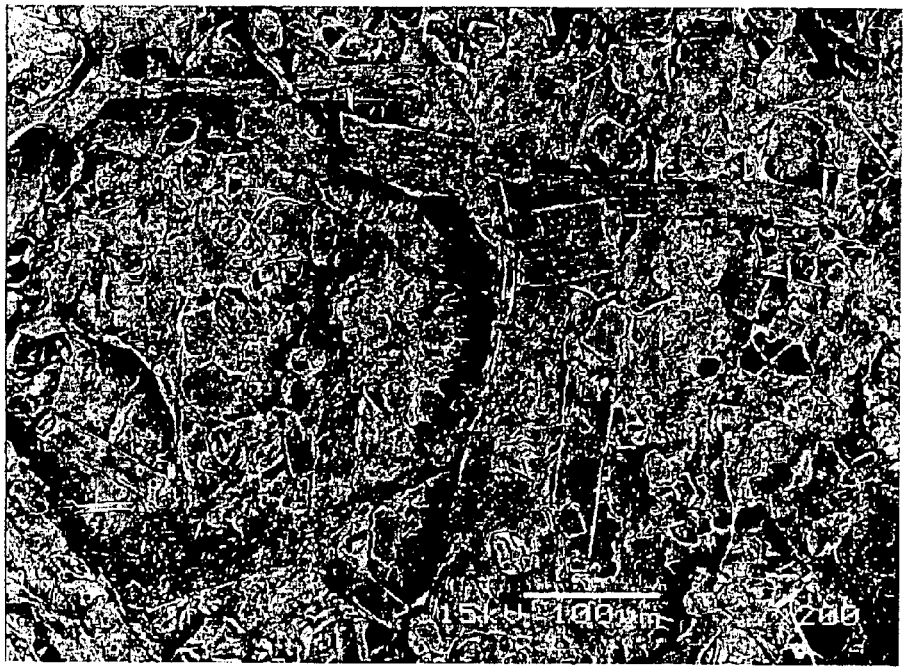
Figure 7C:
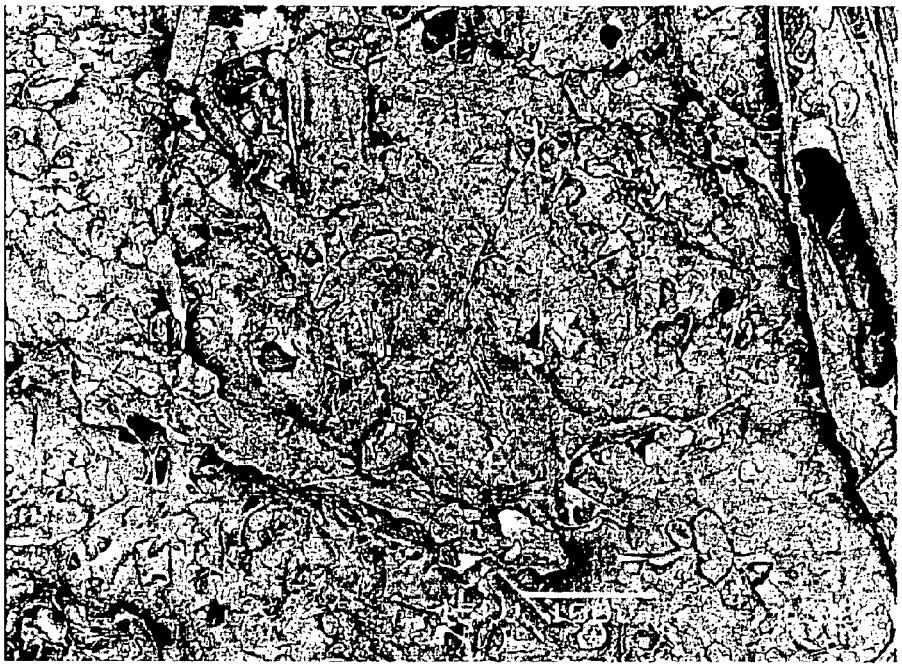
Figure 7D:
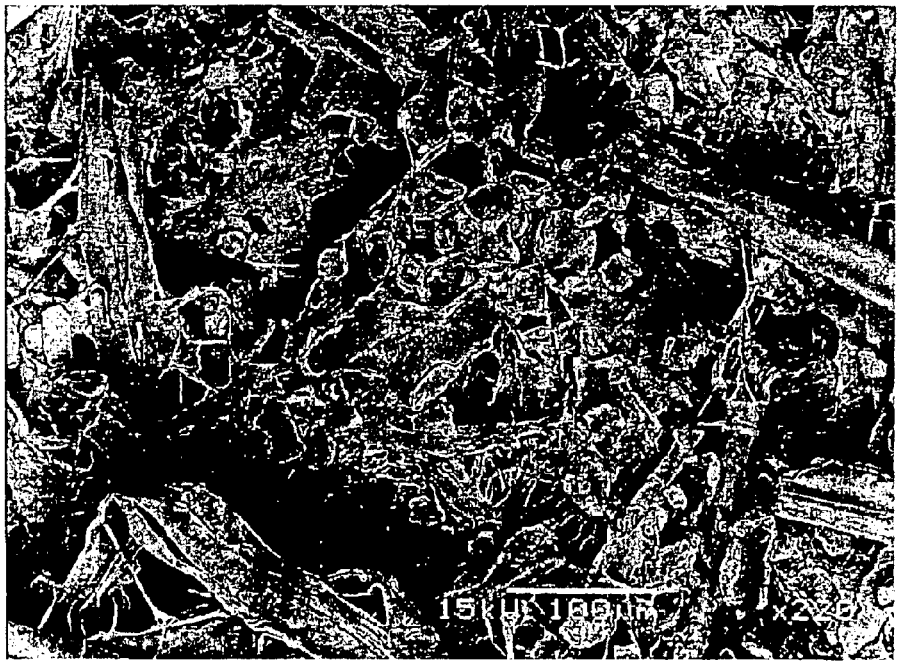

The invention is described in more detail with reference to the appended drawings, in which FIG. 1A shows, in a vertical cross-section, a multi-ring double action impact mill used in a method according to the invention, FIG. 1B shows an alternative solution for FIG. 1A, FIG. 2 shows a device of the type of FIG. 1A in a horizontal cross-section, FIG. 3 shows schematically the addition of coating paste and the discharge of paste-containing sewage in a paper mill for producing coated paper, FIG. 4 shows schematically broke processing in a paper mill for producing coated paper according to the invention FIG. 5 shows the proportion of certain granule sizes in the material as a differential distribution, FIG. 6 shows the proportion of certain granule sizes in the material as a cumulative distribution, FIG. 7*a* shows the material to be supplied to disintegration, FIG. 7*b* shows the disintegrated material, FIG. 7*c* shows the accepted material to be returned to the manufacturing process, and FIG. 7*d* shows the final rejected material.

FIG. 1 shows, in a vertical cross-section, a double action impact mill 20 used in the method according to the invention, comprising a housing 10 which accommodates a rotor 11 equipped with blades 1*a*,1*b* . . . , 3*a*,3*b* . . . etc. (single blades are shown more precisely in FIG. 2). The housing also accommodates a second rotor 12 which is concentric with the first rotor 11. The second rotor 12 is also equipped with blades 2*a*,2*b* . . . , 4*a*,4*b* . . . etc. The blades 1*a*,1*b* . . . , 2*a*,2*b* . . . , 3*a*,3*b* . . . of the first rotor 11 and the second rotor 12 are arranged in concentric rings 1, 2, 3 . . . in such a way that the rings 1, 3, 5 of the first rotor 11 and the rings 2, 4 of the second rotor 12 are intermeshed. Thus, the rotors 11 and 12 with their blades can freely rotate in different directions.

The end of the housing is provided with an opening 14 which opens out to the nave of the rotors 11 and 12 and is used as a feed opening for reject flows to be processed. This feeding arrangement is possible, because the shafts of the rotors are arranged within each other, as in the solution described in patent application Fl 946048. The wall of the housing is provided with an opening 15 which opens to the outermost blade ring and is used as a delivery outlet.

The second rotor 12 can also be replaced with a stator equipped with blades, but the solution with two rotors is preferred. The rotors rotating in opposite directions produce strong centrifugal forces which effectively keep the flow-throughs in motion, which cannot be achieved by a stator-rotor system.

FIG. 2, which illustrates a device of the type of FIG. 1 in a horizontal cross-section (in effect, modified in such a way that each rotor 11, 12 has one more ring than the device of FIG. 1), shows the directions of rotation of the rotors. Each rotor can naturally also rotate in the opposite direction.

The ring wall of the housing of the double action impact mill does not need to be in the direct vicinity of the pair of rotors, but it can be placed at a further distance, wherein the housing can be very spacious. The function of the housing is thus primarily to act as a vessel for collecting the processed material. FIG. 1B shows a solution in which the device to be used in the method of the invention is not equipped with a separate fixed housing. The device comprising a pair of rotors 11, 12 is arranged in a container 30 which has an opening 14*a* in connection with the feed opening 14 and has a discharge outlet 15*a* for the processed material flow.

According to the solution of FIG. 2, the horizontal distance L between the rings 1, 2, 3 . . . is about 3 mm and is equal between all the rings. According to an advantageous embodiment which is not shown in the figure, the device is constructed or adjusted in such a way that the distance L between adjacent rings is reduced towards the outermost ring 7 of the device. The distance L between the outermost rings 6 and 7 is preferably about 0.2 mm.

According to an advantageous embodiment, the device is constructed in such a way that the distance S between the blades in the outermost rings is smaller than the distance between the blades in the inner rings.

The above-mentioned measures can be used to secure that material flows which contain more coarse agglomerates can be fed into the device but sufficiently well ground material can still be achieved. The substantial advantage is that the number of blades in the rotor rings and the distances (tightness) between the rings are selected according to the need. The distance between the rings, as well as the distance between the blades in the ring, can be arranged to reduce towards the outer ring. Thus, the disintegrating agglomerates, or the like, are forced into tighter and tighter spaces before the obtained suspension is discharged from the device.

According to FIG. 2, the blades of the rings, whose cross-sectional-profile is rectangular, are turned in such a way that the impact surfaces of the blades are radial. Furthermore, the blades of one or more rings can be turned, e.g. to increase the impact power, in such a way that the direction of their impact surfaces deviates from the radial direction. The cross-sectional profile of the rings can naturally also be changed from the rectangular shape to the triangular shape, wherein the impact surfaces of the blade are not parallel but form a certain angle with each other.

The rotors of the double action impact mill rotate at rates of 1500 to 3000 $min^{-1}$, preferably about 1600 $min^{1}$.

EXAMPLE 1

A test was made at a paper mill for manufacturing coated paper. Sewage (A) which was produced in connection with coating of paper and contained coating paste was supplied, together with a reject (B) produced in vortex cleaning at a vortex cleaning plant of a paper machine, to a double action impact mill. The quantity of the suspension was 5 . . . 10 $m^3$/h, the consistency 1. . . 4%, and ash content 35. . . 50% (FIGS. 3 and 4, points A and B together). After the processing, the material suspension was led to a dilution container and, after that, to a vortex cleaner in the apparatus, wherein the accept was recirculated to the supply of the 2nd step of the vortex cleaning plant of the paper machine, and the reject was discarded to a refuse dump. The recovery degree obtained with the device varied from 90 to 96%.

During the test run period of two weeks, no problems were observed at the paper machine.

In the above-described tests, a double action impact mill was used, whose both rotors comprised two blade rings. The rotational speed of the motor of the upper rotor was 1500 1/min, and the rotational speed of the motor of the lower rotor was 1800 1/min. The maximum flow supplied to the double action impact mill was 10 $m^3$/h.

According to a particularly preferable way of running, the rotational speed of the outermost ring is 40 to 80 m/s.

By optimizing the running conditions, it is naturally possible to obtain even better results than those mentioned above.

EXAMPLE 2

A test was made at a paper mill for manufacturing coated paper. Paste-containing sewage was led together with the reject produced at vortex cleaning to the double action impact mill. From the continuous process, samples were taken at two different moments of time (test points 1 and 2), the results being shown in Table 1.

TABLE 1

Results of the mill test run.

| Test point | Property | Supply | Returned accept | Final reject |
|---|---|---|---|---|
| Test point 1 | Consistency (%) | 1,73 | 0,46 | 1,05 |
| | Ash (%) | 43,9 | 44,6 | 38,5 |
| | Return (%) | 96,5 | | |
| Test point 2 | Consistency (%) | 1,30 | 0,43 | 0,65 |
| | Ash (%) | 38,0 | 38,5 | 36,9 |
| | Return (%) | 95,5 | | |

As seen from the results of Table 1, the ash content of the final reject is lower than that of the returned accept. Consequently, the fillers are very efficiently returned to the papermaking process. The recovery degree was very high, more than 95% at each test point.

No problems occurred in the test run, wherein the raw materials contained in the reject flows can be returned to the beginning of the papermaking process. So-called white pitch problems, which refer to problems caused by resin and latex, did not occur in the wire section of the paper machine.

Further, it was examined how the turbidity values of the material flow combined from the sewage flow which contained coating paste and the reject flow from the vortex cleaner were changed. The turbidity of material to be supplied to disintegration has been about 200 NTU, and the turbidity of the disintegrated material has been about 15 NTU. From this, it can be deduced that in connection with the disintegration, reactive surfaces are formed, to which the substances that have previously caused problems, such as latexes, adhere.

FIGS. 5 and 6 show the effect of disintegration on the granule size. As seen from the drawings, the fraction of large granules is clearly reduced in the disintegrated material, when compared with the material supplied.

The limit percentage shown by the vertical axis in FIG. 6 indicates the percentage of particles in the material that are smaller than the granule class shown by the horizontal axis. For example, there are about 43% of the particles that are smaller than the granule class 100 $\mu$m in the supply, about 58% in the disintegrated material, about 54% in the returned accept, and about 43% in the final reject. The percentage values shown are volume percentages.

FIGS. 7*a* to 7*d* show material flows of the mill test run as images of scanning electron microscopy (SEM). FIG. 7*a* shows a microscopic image of a reject flow which is combined of a sewage which contains coating paste and a filled reject flow before it is supplied to disintegration in a double action impact mill. FIG. 7*b* shows the material disintegrated in the double action impact mill. In the next step, the disintegrated material is classified into reject and accept. FIG. 7*c* shows the accept to be returned to the manufacturing process, and FIG. 7*d* shows the final reject which is totally removed from the process. The figures show the adhesion of problematic substances to reactive surfaces.

It will be obvious for anyone skilled in the art that various embodiments may vary within the scope of the claims to be presented below.

What is claimed is:

1. A method for processing filled reject flows in a paper or board mill, wherein at least one sewage flow which contains coating paste and at least one reject flow from a vortex cleaner are led to be simultaneously disintegrated in one material flow using cyclic shocks of pressure and underpressure, and the disintegrated filled material flow is led to be re-used at least partly in the manufacture of paper or board.

2. The method according to claim 1, wherein the filled reject flows are led to be disintegrated in a device operating on the principle of a multi-ring double action impact mill.

3. The method according to claim 2, wherein the filled reject flows are led to be disintegrated simultaneously as one material flow to a feed opening of a double action impact mill, which is arranged to open out to a nave of two concentric rotors equipped with blades and rotating in opposite directions, or to a nave of a rotor and a stator.

4. The method according to claim 3, wherein the filled material flow is brought to flow via blades of the rotors arranged within each other, or a rotor and a stator arranged within each other, to the ring of an outermost rotor or stator and to be discharged from the device.

5. The method according to claim 1, wherein the filled material flow disintegrated in a double action impact mill is sorted into accept and reject.

6. The method according to claim 5, wherein the reject is recirculated in whole or in part, once or several times, to a double action impact mill.

7. The method according to claim 5, wherein the reject is led to another double action impact mill coupled in series with the double action impact mill.

8. The method according to claim 1, wherein the filled material flow processed in the double action impact mill is supplied, after the disintegration, at least partly back to a vortex cleaning plant in the paper or board machine.

9. A method for processing filled reject flows in a paper or board mill, wherein at least one sewage flow which contains coating paste and at least one reject flow from a vortex cleaner are led to be simultaneously disintegrated in one material flow using cyclic shocks of pressure and underpressure, fractionating the disintegrated filled material into an accept flow and a reject flow, and using at least part of the accept flow in the manufacture of paper or board.

* * * * *